United States Patent [19]

Willoughby

[11] Patent Number: 4,998,641

[45] Date of Patent: Mar. 12, 1991

[54] TOP FOR BEVERAGE CAN

[76] Inventor: D. Dean Willoughby, 1630 Fremont Ave., Cheyenne, Wyo. 82001

[21] Appl. No.: 442,949

[22] Filed: Nov. 29, 1989

[51] Int. Cl.[5] ..... B65D 41/32

[52] U.S. Cl. ..... 220/268; 220/90.2; 220/90.6; 220/269

[58] Field of Search ..... 220/1 BC, 90.2, 90.4, 220/90.6, 260, 269, 270, 272, 273, 268

[56] References Cited

U.S. PATENT DOCUMENTS

| | | | |
|---|---|---|---|
| 3,429,478 | 2/1969 | Ward | 220/90.2 |
| 3,438,533 | 4/1969 | Hanisch et al. | 220/90.6 |
| 3,704,805 | 12/1972 | Sheafe, III | 220/54 |
| 3,977,561 | 8/1976 | Strobe et al. | 220/269 |
| 4,084,722 | 4/1978 | Rosynek et al. | 220/270 |
| 4,210,257 | 7/1980 | Radtke | 220/269 |
| 4,377,244 | 3/1983 | Rossetti | 220/268 |
| 4,909,407 | 3/1990 | Lambert et al. | 220/268 |

FOREIGN PATENT DOCUMENTS

| | | | |
|---|---|---|---|
| 2738938 | 3/1979 | Fed. Rep. of Germany | 220/90.4 |

*Primary Examiner*—Stephen Marcus
*Assistant Examiner*—Vanessa M. Roberts
*Attorney, Agent, or Firm*—Dean P. Edmundson

[57] ABSTRACT

A top member for a beverage container which includes a scored portion which can be displaced to provide an access opening, in which the improvement relates to the provision of raised portions adjacent the access opening area to reduce or prevent spillage when drinking from the container. The raised portions can be integral with the top member and can be continuous along two side edges and the front edge of the access opening.

8 Claims, 2 Drawing Sheets

TOP FOR BEVERAGE CAN

FIELD OF THE INVENTION

This invention relates to beverage cans. More particularly, this invention relates to an improved top for a beverage can.

BACKGROUND OF THE INVENTION

Beverage cans typically include a horizontal top member which is recessed and includes an easy-open closure system (e.g., a ring-pull or similar closure system). Because the top member is recessed by as much as 0.25 inch from the top lip of the can, it can be difficult to drink from the can without spilling a portion of the contents of the can. This is especially true when small children attempt to drink from such cans.

There has not heretofore been provided a top member for beverage cans having the advantages provided by the present invention.

SUMMARY OF THE INVENTION

In accordance with the present invention there is provided an improved top for a beverage container. The top is generally horizontal and includes a closure system of the conventional type which includes a scored opening section which is adapted to be displaced from the plane of the top member to create an opening through the top member for allowing access to the contents of the container.

The improvement of the present invention comprises raised portions in the top member adjacent the edges of the scored opening. The raised portions are curved in cross-section and preferably have a convex upper surface. The presence of the raised portions is effective in preventing spillage of the contents of the container during drinking.

Other advantages and features of the present invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
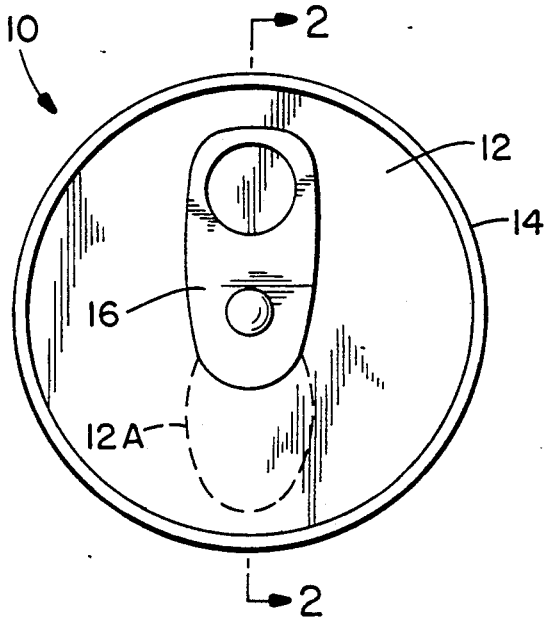
FIG. 1 PRIOR ART
FIG. 1 is a top view of a conventional top member for a beverage container, including a conventional closure system.
Figure 2:
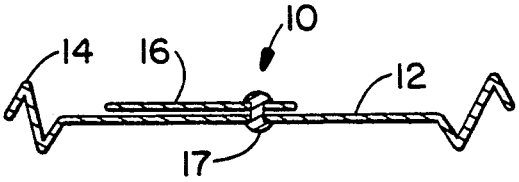
FIG. 2 PRIOR ART
FIG. 2 is a cross-sectional view of the top member shown in FIG. 1, taken along line 2—2.

FIGS. 1 and 2 illustrate a conventional top member 10 for a beverage container (e.g., a steel or aluminum can) having a generally planar section 12 which is horizontal. It includes a scored portion 12A which is adapted to be displaced from the plane of section 12 in order to allow access to the contents of the container.

Conventionally, there is a closure system comprising a lever member 16 secured to the top by means of a rivet 17. To open the container the lever is grasped and lifted. This forces the scored portion 12A to be displaced downwardly out of the plane of the top to leave an opening. Other types of closure systems may also be used, of course, so long as the top includes a scored portion defining an area or portion of the top to be displaced to provide an opening. If desired, the lever member and scored opening may be slightly recessed in the top member.

The edge 14 of the top member is adapted to be crimped onto the upper edge of the beverage container during the packaging of the desired contents in the container. As illustrated, the edge 14 is higher than the planar section 12. This can make it difficult to drink from the container without spilling. It is especially difficult for small children. The planar section 12 may be recessed as much as 0.25 inch from the top lip 14.

Figure 3:
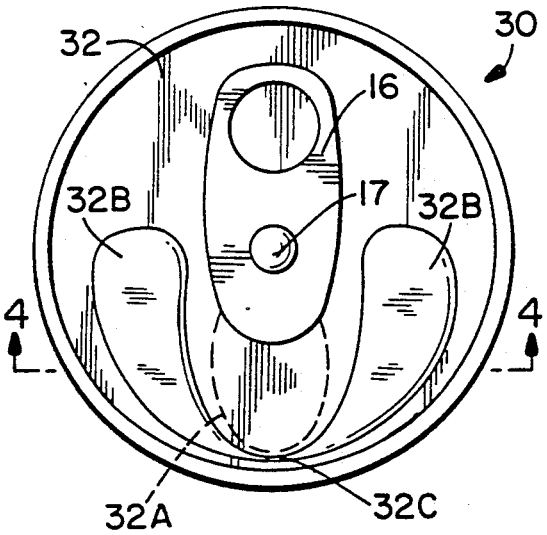
FIG. 3 is a top view of an improved top member of this invention.
Figure 4:
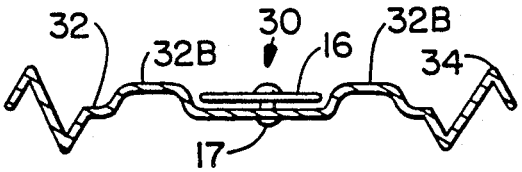
FIG. 4 is a cross-sectional view of the improved top member of FIG. 3, taken along line 4—4.

FIGS. 3 and 4 illustrate a preferred embodiment of the improvement of the present invention. Thus, these figures illustrate a top member 30 which includes a scored portion 32A and raised portions 32B adjacent the scored portion 32A. These raised portions are curved in cross-section and are preferably convex, as illustrated, and extend above the planar portion 32 at least about 1/16 inch. They may extend upwards from portion 32 as much as ¼ inch, if desired.

Figure 5:
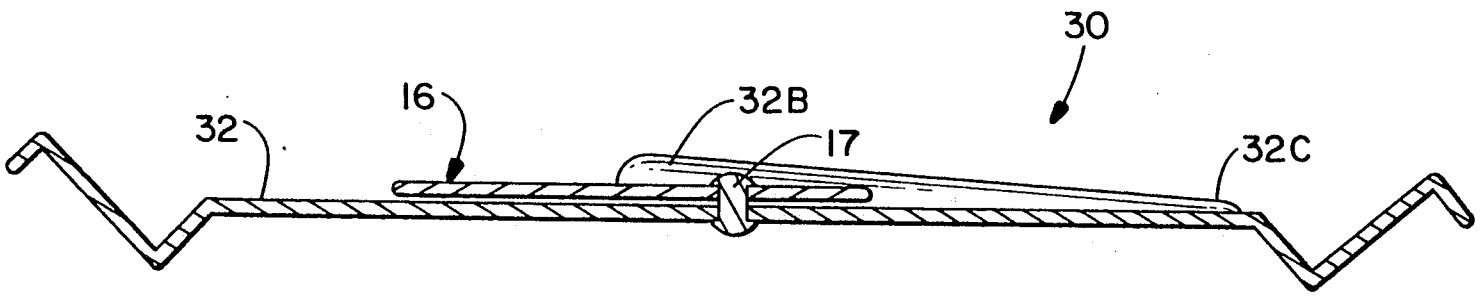
FIG. 5 is a cross-sectional view of the improved top member of FIG. 3, taken through the center of the top member along a line perpendicular to line 4—4.

The raised portion 32C which is adjacent the front edge of the scored portion is narrower than raised portions 32B along the sides of the scored portion. Portion 32C may also be lower than portions 32B. In other words, portions 32B are typically higher than portion 32C, as illustrated in FIG. 5.

The width of portions 32B may also vary. Generally the width should be at least about 1/16 inch and it may be as much as ½ inch.

The presence of the raised portions on the top member provides more surface area for the upper lip to contact when drinking from the container. This greatly reduces spillage during drinking from the container. It also makes it easier to drink from the container, and it prevents the lip from directly contacting the lever 16. Air can also pass easily into the container past the lever and between the ends of the two raised portions 32B.

The improved top of this invention may be easily produced by appropriate die stamping of metal (e.g., steel).

As illustrated, preferably the raised portions are integral with the horizontal main portion 32 of the top member. Alternatively, the raised portions could be provided as separate members secured to the top of a planar horizontal portion 32. Preferably the raised portions 32B are continuous along substantially the full length of each side edge of the scored portion 32A. It is also preferred for the portions 32B to be connected to each other via portion 32C to form a generally U-shaped configuration around the access opening, as illustrated.

Other variants are possible without departing from the scope of the present invention. For example, the raised portions 32B may be separate portions adjacent opposite sides of the scored portion 32A.

What is claimed is:

1. An improved top member for a beverage container of the type including a horizontal member, a scored portion which is adapted to be displaced from the plane of said horizontal member to provide an opening in said top member having two side edges, a front edge and a rear edge, and means for displacing said scored portion from said horizontal member; wherein the improvement comprises raised portions adjacent said scored portion, wherein said raised portions include an upper surface which has a curved cross-section; wherein said raised portions project upwardly from the plane of said horizontal member at least about 1/16 inch; and wherein said raised portions extend along the full length of said opening and past said rear edge thereof; wherein said raised portions are integral with said horizontal member; and wherein said raises portion which is adjacent said front edge of said opening is lower than said raised portions which are adjacent said side edges of said opening.

2. The improvement in accordance with claim 1, wherein said raised portions form a continuous U-shape along said side edges and said front edge of said opening.

3. The improvement in accordance with claim 1, wherein said upper surface of said raised portions is convex.

4. The improvement in accordance with claim 1, wherein the width of each said raised portion adjacent a side edge of said scored portion is in the range of about 1/16 to $\frac{1}{4}$ inch.

5. An improved top member for a beverage container of the type including a horizontal member, a scored portion which is adapted to be displaced from the plane of said horizontal member to provide an opening in said top member having two side edges, a front edge and a rear edge, and means for displacing said scored portion from said horizontal member; wherein the improvement comprises a raised portion adjacent each side edge of said scored portion, wherein each said raised portion includes an upper surface which has a curved cross-section, wherein said raised portions are integral with said horizontal member; wherein said raised portions project upwardly from the plane of said horizontal member at least about 1/16 inch; and wherein said raised portions extend along the full length of said opening and past said rear edge thereof; wherein said raised portions form a continuous U-shape along said side edges and said front edge of said opening; and wherein said raised portion which is adjacent said front edge of said opening is lower than said raised portions which are adjacent said side edges of said opening.

6. The improvement in accordance with claim 5, wherein said upper surface of said raised portions is convex.

7. The improvement in accordance with claim 5, wherein the width of each said raised portion adjacent a side edge of said scored portion is in the range of about 1/16 to $\frac{1}{4}$ inch.

8. The improvement in accordance with claim 5, wherein the height of each said raised portion is in the range of about 1/16 to $\frac{1}{4}$ inch.

* * * * *